US007270732B2

(12) United States Patent
Chang et al.

(10) Patent No.: US 7,270,732 B2
(45) Date of Patent: Sep. 18, 2007

(54) METHOD FOR ENHANCING BONDING STRENGTH OF A METAL SPRAYING THICKENED LAYER OF ELECTROFORMED MOLD INSERTS

(75) Inventors: Chia-Hua Chang, Yangmei Township, Taoyuan County (TW); Jen-Chin Wu, Jhongli (TW)

(73) Assignee: Chung Shan Institute of Science and Technology, Taoyuan County (TW)

( * ) Notice: Subject to any disclaimer, the term of this patent is extended or adjusted under 35 U.S.C. 154(b) by 566 days.

(21) Appl. No.: 10/968,997

(22) Filed: Oct. 21, 2004

(65) Prior Publication Data

US 2006/0086615 A1 Apr. 27, 2006

(51) Int. Cl.
*C25D 1/10* (2006.01)

(52) U.S. Cl. ..... 205/70; 205/170; 205/184; 427/421.1

(58) Field of Classification Search ..... 205/67, 205/70, 170, 183–185, 191; 427/421.1
See application file for complete search history.

(56) References Cited

U.S. PATENT DOCUMENTS 3,784,451 A * 1/1974 Garner ..... 205/70

* cited by examiner

*Primary Examiner*—Edna Wong
*Assistant Examiner*—Luan V. Van
(74) *Attorney, Agent, or Firm*—Rabin & Berdo, P.C.

(57) ABSTRACT

A method for enhancing bonding strength of a metal spraying thickened layer of electroformed mold inserts includes the following procedures: forming a plurality of stereoscopic reinforced ribs on an electroformed metal shell mold by metal spraying; covering the stereoscopic reinforced ribs and the electroformed metal shell mold to become an integrated body by electroforming; forming a metal thickened layer by metal spraying; forming a second electroformed cover and forming a metal key bond between the electroformed cover and the metal thickened layer. The method of the invention can shorten fabrication time of the electroformed mold insert and improve the mechanical strength and soldering affinity of the metal thickened layer.

17 Claims, 2 Drawing Sheets

METHOD FOR ENHANCING BONDING STRENGTH OF A METAL SPRAYING THICKENED LAYER OF ELECTROFORMED MOLD INSERTS

FIELD OF THE INVENTION

The invention relates to an electroforming technique, and particularly to a method for enhancing the bonding strength of a metal spraying thickened layer of electroformed mold inserts.

BACKGROUND OF THE INVENTION

The conventional mold fabrication industry usually uses CNC machine tools, copy engraving machines or electric spark machining to do fabrication directly on molding steel. Due to limitations of the tools and precision of the machine tools, conventional machining cannot fabricate molds of miniature geometric profiles, special optical characteristics and high levels of precision, such as the miniature molds for fabricating micro devices. Such molds have to be fabricated by electroforming.

Electroforming is an electroplating technique to produce a thick layer of metal shell mold on a mandrel. The metal shell is peeled off the mandrel to become a duplicate of the mandrel, and it is finished by machining and trimming. It can be used to produce precise and complicated molds in large quantity that are difficult to fabricate by conventional machining or require too much manpower. The duplicate may reach the precision of 2.5 μm and the surface resolution can reach 0.02~0.05 μm. Hence this molding technique is desirable for fabricating molds used in production of CDs, reflection sheets of car lights, light guide plates of liquid crystal displays and the like.

However, in conventional electroforming techniques, the depositing speed of electroforming is very slow, about 0.5-1 mm/day. For instance, to form a mold insert by electroforming for a thickness of 30 mm, submerged electroforming time could be six to eight weeks. The slow depositing speed of the electroforming process is a technical bottleneck awaiting resolution.

On the other hand, metal spraying is a physical metal depositing technique that has a high depositing speed (about 20-180 kg/hr). It can be used to brace and thicken the electroformed mold insert, greatly reduce the submerged electroforming time, and fabricate the mold at a faster speed.

However, the metal spray thickened layer and the electroformed layer are bonded by mechanical keys. The metal spray thickened layer is formed by stacking hundreds of metal films. The metal spray film fabricated by the present metal spray equipment has tension stress. This tension stress increases as the thickness of the metal spray layer increases. When the tension stress of the metal spray thickened layer is greater than the key bonding strength of the metal spray thickened layer and the bottom material, the metal spray thickened layer can easily peel off. The poor bonding strength of the metal spray layer is the main drawback of the metal spray thickening process. Moreover, thermal effects during the metal spray process can also cause deformation of the electroformed layer, affecting the strength of the metal spray layer and resulting in soldering defects. These are the disadvantages of the metal spray technique.

SUMMARY OF THE INVENTION

In view of the aforesaid problems occurring with the conventional techniques, an object of the invention is to provide a method for enhancing bonding strength of a metal spraying thickened layer of electroformed mold inserts to increase the bonding strength between an electroformed layer and a metal spraying thickened layer, and enhance the mechanical strength and soldering affinity of the metal spraying thickened layer through an electroformed cover.

In order to achieve the foregoing object, the method of the invention includes the following procedures: first, providing an original mandrel; next, submerging the mandrel in a first electroforming solution to form an electroformed shell mold; then forming a plurality of stereoscopic reinforced ribs on the electroformed shell mold by metal spraying; next, submerging the electroformed shell mold attached to the stereoscopic reinforced ribs in a second electroforming solution to form an electroformed cover; forming a metal spray thickened layer on the electroformed shell mold and the stereoscopic reinforced ribs, and if necessary, forming a nickel aluminum alloy layer by metal spraying in advance and blasting the surface thereof with emery to form a coarse surface; grinding the metal spray thickened layer by machining; submerging in a third electroforming solution to form a second electroformed cover; finally separating the original mandrel and the electroformed metal mold insert.

DESCRIPTION OF THE PREFERRED EMBODIMENTS

Refer to FIGS. 1 and 2A through 2E for the process of the method of the invention and the structure at each stage.

Figure 1:
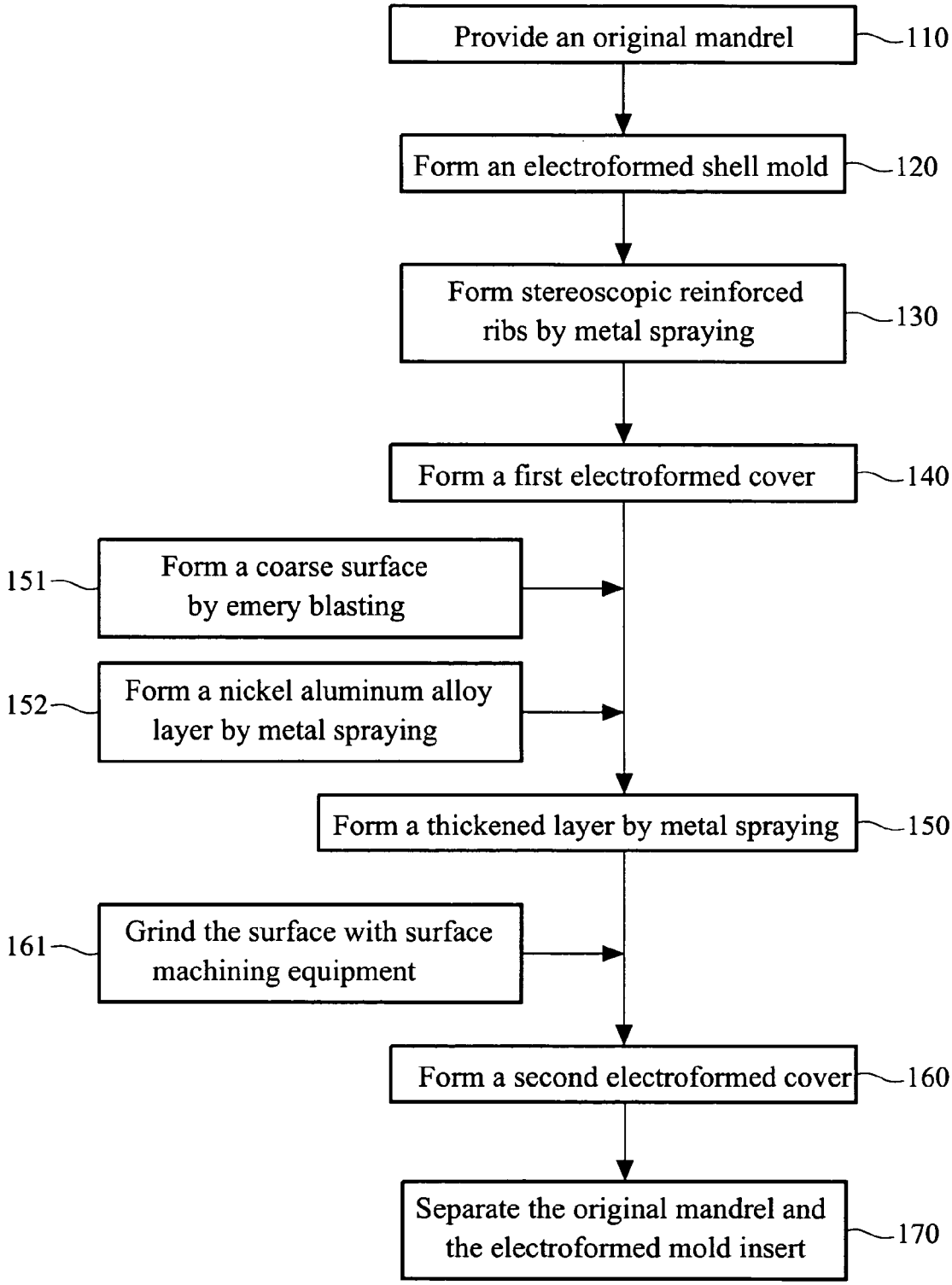
FIG. 1 is the main process flow chart of the method of the invention.
Figure 2A:
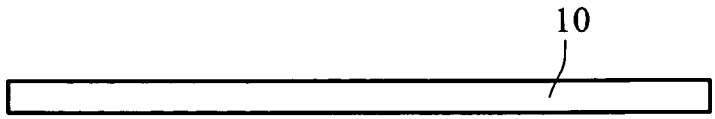
FIGS. 2A through 2E are schematic views of the structure at various stages of the invention.

First, provide an original mandrel (step 110). Next, form an electroformed shell mold (step 120) with an electroformed shell 10 at a thickness of 1-3 mm by submerging the original mandrel in a first electroforming solution, as shown in FIG. 2A. The first electroforming solution is composed of nickel, copper and alloys thereof. The operation parameters of electroforming are a current density of 5-25 ASD and the electroforming solution temperature at 20-80° C.

Figure 2B:
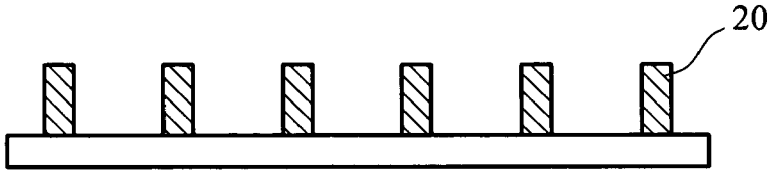

Next, form a plurality of stereoscopic reinforced ribs 20 on desired locations of the electroformed shell 10 by metal spraying (step 130) as shown in FIG. 2B. The materials of the reinforced ribs may be copper, iron, nickel, titanium, stainless steel and alloys thereof. The operation parameters of metal spraying are as follows: (i) spraying distance: 40-60 cm; (ii) spraying pressure: 35-70 psi; (iii) compressed air pressure: 70 psi; (iv) compressed airflow: 52 CFM; (v) acetylene pressure: 15 psi; (vi) acetylene flow: 40 CFM; (vii) oxygen pressure: 30 psi; (viii) oxygen flow: 44 CFM.

Next, form a first electroformed cover (step 140) by submerging the electroformed shell mold attached to the stereoscopic reinforced ribs in a second electroforming solution. The second electroforming solution may be the same as the first electroforming solution or different. After submerging in the second electroforming solution for 8-12 hours, the stereoscopic reinforced ribs 20 and the original electroformed shell mold 10 are coupled integrally by the first electroformed cover to become a stereoscopic reinforced ribs-attached electroformed shell mold 30 (referring to FIG. 2C).

Figure 2C:
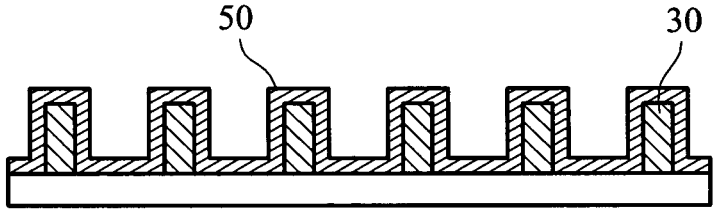
Figure 2D:
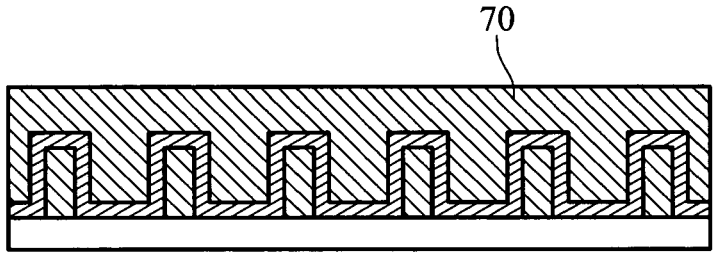
Figure 2E:
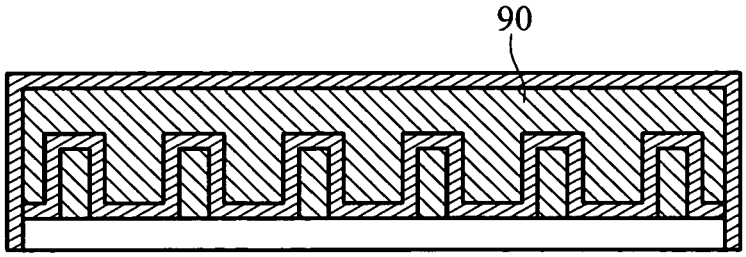

Next, to increase the bonding effect of the metal spraying thickened layer and the electroformed shell mold, the stereoscopic reinforced ribs-attached electroformed shell mold 30 is blasted with emery to form a coarse surface (step 151, not shown in the drawings). The blasting pressure is about 50-70 psi. Then spray a layer of nickel aluminum alloy (step 152) to form a nickel aluminum alloy layer 50 on the stereoscopic reinforced ribs-attached electroformed shell mold 30, as shown in FIG. 2C. The nickel in the nickel aluminum alloy and the stereoscopic reinforced ribs-attached electroformed shell mold 30 jointly form a key-bonding layer.

Next, form a metal spraying thickened layer (step 150) by spraying a metal thickened layer 70 on the nickel aluminum alloy layer 50. The material of the metal thickened layer 70 may be the same as the stereoscopic reinforced ribs, namely copper, iron, nickel, titanium, stainless steel and alloys thereof. Then grind the surface of the metal thickened layer 70 by surface machining tools (step 161). Form a second electroformed cover (step 160) to finish a complete electroformed mold insert 90, and separate the original mandrel and the electroformed mold insert 90 (step 170).

The electroformed mold insert covered by the second electroformed cover may be fastened to a mold seat by screwing or soldering to become a complete mold set.

The metal spraying technique adopted in the invention may be flame powder spraying, flame wire spraying, or arc spraying. The stereoscopic reinforced ribs can provide sufficiently reinforced strength to bond the electroformed shell mold and the thickened layer. Therefore, forming the nickel aluminum alloy layer and the coarse surface by emery blasting is not necessary. Moreover, grinding the surface of the metal spraying thickened layer can improve the surface quality of the electroformed mold insert covered by the second electroformed cover. However, this is also not necessary in terms of enhancing the bonding strength of the thickened layer and the original electroformed shell mold.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A method for enhancing bonding strength of a metal spraying thickened layer of electroformed mold inserts, comprising the steps of:

a. providing an original mandrel;

b. forming an electroformed metal shell mold by submerging the original mandrel in a first electroforming solution;

c. forming a plurality of stereoscopic reinforced ribs on the electroformed metal shell mold by metal spraying;

d. forming a first electroformed cover by submerging the electroformed metal shell mold attached with the stereoscopic reinforced ribs in a second electroforming solution to couple the stereoscopic reinforced ribs and the electroformed metal shell mold in an integrated body;

e. spraying a metal thickened layer on the electroformed metal shell mold attached with the stereoscopic reinforced ribs to form an electroformed mold insert;

f. grinding the electroformed mold insert and submerging the electroformed mold insert in a third electroforming solution to form a second electroformed cover; and g. separating the original mandrel and the electroformed mold insert.

2. The method of claim 1, wherein the first electroforming solution at the step b is composed of nickel, copper and alloys thereof.

3. The method of claim 1, wherein the first electroforming solution at the step b is processed in a condition of current density of 5-25 ASD and temperature of 20-80° C.

4. The method of claim 1, wherein the stereoscopic reinforced ribs at the step c are selectively formed by flame powder spraying, flame wire spraying, or arc spraying.

5. The method of claim 1, wherein the stereoscopic reinforced ribs at the step c are made from a material selected from the group consisting of copper, iron, nickel, titanium, stainless steel and alloys thereof.

6. The method of claim 1, wherein the metal spraying at the step c is processed at a distance of 40-60 cm.

7. The method of claim 1, wherein the metal spraying at the step c is processed at a pressure of 35-70 psi.

8. The method of claim 1, wherein the second electroforming solution at the step d is composed of nickel, copper and alloys thereof.

9. The method of claim 1, wherein the second electroforming solution at the step d is processed in a condition of current density of 5-25 ASD and temperature of 20-80° C.

10. The method of claim 1, wherein the step e is followed by a process (e1) of blasting the electroformed metal shell mold attached with the stereoscopic reinforced ribs by emery to form a coarse surface.

11. The method of claim 1, wherein the step e is followed by a process (e2) of forming a nickel aluminum alloy layer on the electroformed metal shell mold attached with the stereoscopic reinforced ribs by metal spraying.

12. The method of claim 1, wherein the step e of spraying a metal thickened layer selectively employs a process of flame powder spraying, flame wire spraying, or arc spraying.

13. The method of claim 1, wherein the metal thickened layer at the step e is made of a material selected from the group consisting of copper, iron, nickel, titanium, stainless steel and alloys thereof.

14. The method of claim 1, wherein the spraying at the step e is processed at a distance of 40-60 cm.

15. The method of claim 1, wherein the spraying at the step e is processed at a pressure of 35-70 psi.

16. The method of claim 1, wherein the third electroforming solution at the step f is composed of nickel, copper and alloys thereof.

17. The method of claim 1, wherein the second electroformed cover at the step f is formed in a process condition of current density of 5-25 ASD and temperature of 20-80° C.

* * * * *